US009771188B2

(12) United States Patent
Glassman

(10) Patent No.: US 9,771,188 B2
(45) Date of Patent: Sep. 26, 2017

(54) PERSONAL UTENSIL AND CONTAINER

(71) Applicant: Kindle Hill, LLC, Gwynedd Valley, PA (US)

(72) Inventor: Saly A. Glassman, Gwynedd Valley, PA (US)

(73) Assignee: KINDLE HILL, LLC, Gwynedd Valley, PA (US)

( * ) Notice: Subject to any disclaimer, the term of this patent is extended or adjusted under 35 U.S.C. 154(b) by 592 days.

(21) Appl. No.: 14/372,139

(22) PCT Filed: Jan. 11, 2013

(86) PCT No.: PCT/US2013/021123

§ 371 (c)(1),
(2) Date: Jul. 14, 2014

(87) PCT Pub. No.: WO2013/106634

PCT Pub. Date: Jul. 18, 2013

(65) Prior Publication Data

US 2014/0332439 A1 Nov. 13, 2014

Related U.S. Application Data

(60) Provisional application No. 61/586,302, filed on Jan. 13, 2012.

(51) Int. Cl.
*A47G 29/08* (2006.01)
*B65D 43/16* (2006.01)
(Continued)

(52) U.S. Cl.
CPC ..... *B65D 43/169* (2013.01); *A45C 11/20* (2013.01); *A45F 5/00* (2013.01); *A47G 21/02* (2013.01);
(Continued)

(58) Field of Classification Search
CPC .. A47G 29/08; A47G 2021/002; A47G 21/14; A47G 21/06; B65D 43/169;
(Continued)

(56) References Cited

U.S. PATENT DOCUMENTS 2,682,950 A 7/1954 Mercer
D303,001 S 8/1989 Su
(Continued)

FOREIGN PATENT DOCUMENTS

CN 86201107 U 3/1987
CN 201668224 U 12/2010
(Continued)

OTHER PUBLICATIONS

International Search Report issued Apr. 1, 2013 in Int'l Application No. PCT/US2013/021123.
(Continued)

*Primary Examiner* — Steven A. Reynolds
(74) *Attorney, Agent, or Firm* — Panitch Schwarze Belisario & Nadel LLP

(57) ABSTRACT

A personal utensil and container for transporting the utensil in a relatively sanitary fashion includes a first container portion and a second container portion pivotably mounted to the first container portion. The first container portion is pivotable between a closed position defining a storage cavity and an open position exposing a first inner surface of the first container portion and a second inner surface of the second container portion. The utensil is mountable within the storage cavity. A hinge is secured to the first and second container portions and defines a pivot axis. The first and second container portions are pivotable about the pivot axis. A lock mechanism is mounted to the first container portion. The lock mechanism engages the second container portion
(Continued)

in the closed position to releasably secure the first container portion to the second container portion.

15 Claims, 12 Drawing Sheets

(51) Int. Cl.

| | |
|---|---|
| ***A45C 11/20*** | (2006.01) |
| ***A47G 21/02*** | (2006.01) |
| ***A45F 5/00*** | (2006.01) |
| ***B65D 45/00*** | (2006.01) |
| *A47G 21/00* | (2006.01) |

(52) U.S. Cl.
CPC ..... *A47G 29/08* (2013.01); *B65D 45/00* (2013.01); *A47G 2021/002* (2013.01)

(58) Field of Classification Search
CPC . B65D 45/00; A45F 5/00; A45C 11/20; B67B 7/44
USPC ..... 206/553, 234
See application file for complete search history.

(56) References Cited

U.S. PATENT DOCUMENTS

| | | | | |
|---|---|---|---|---|
| D306,235 | S * | 2/1990 | Tamamura | D3/295 |
| 5,188,234 | A * | 2/1993 | Fukuda | A45C 11/20 206/541 |
| 5,261,560 | A * | 11/1993 | Wang | B65D 51/246 206/372 |
| D367,526 | S | 2/1996 | Bignon | |
| 5,705,212 | A * | 1/1998 | Atkinson | B65D 51/247 206/542 |
| D391,851 | S | 3/1998 | Joergensen | |
| D404,917 | S | 2/1999 | Miller et al. | |
| D409,805 | S | 5/1999 | Lion et al. | |
| 5,921,383 | A | 7/1999 | Shefler et al. | |
| D429,970 | S | 8/2000 | Liu | |
| D430,727 | S | 9/2000 | Wisniewski | |
| 6,371,324 | B1 * | 4/2002 | Torniainen | B65D 51/246 206/541 |
| D474,020 | S * | 5/2003 | Wang | D3/274 |
| D479,401 | S | 9/2003 | Claypool | |
| D480,277 | S | 10/2003 | Claypool | |
| D508,839 | S | 8/2005 | Brown et al. | |
| D550,516 | S | 9/2007 | Tsai | |
| RE40,108 | E | 2/2008 | Kuo | |
| 7,367,449 | B2 | 5/2008 | Kaminski et al. | |
| D575,593 | S * | 8/2008 | Svartstrom | D7/644 |
| D590,213 | S | 4/2009 | Young et al. | |
| D612,148 | S | 3/2010 | Treece et al. | |
| D625,913 | S | 10/2010 | Phillips | |
| D662,320 | S * | 6/2012 | De Leo | D3/201 |
| D673,430 | S | 1/2013 | Glassman | |
| D684,675 | S | 6/2013 | Irvin et al. | |
| 9,434,590 | B2 * | 9/2016 | Miksovsky | B67B 7/44 |
| 2014/0339127 | A1 * | 11/2014 | Dao | B25H 3/006 206/553 |
| 2015/0257562 | A1 * | 9/2015 | Miksovsky | B67B 7/44 206/553 |

FOREIGN PATENT DOCUMENTS

| | | | |
|---|---|---|---|
| CN | 201759268 | U | 3/2011 |
| RU | 77761 | U1 | 11/2008 |
| TW | M311360 | U | 5/2007 |
| WO | 2013106634 | A1 | 7/2013 |

OTHER PUBLICATIONS

Int'l Preliminary Report on Patentability issued Jul. 24, 2014 in Int'l Application No. PCT/US2013/021123.

* cited by examiner

PERSONAL UTENSIL AND CONTAINER

BACKGROUND OF THE INVENTION

Utensils for manipulating food are relatively well known an typically include a fork, spoon, knife, spork or other utensil that are employed to manipulate food or for another useful purpose. Food utensils are typically utilized to avoid direct contact between the food and the user's hand, thereby preventing the user's hands from becoming soiled by the food or transmitting germs or other elements from the hand to the food. The food utensils are typically stored in a user's kitchen and washed following use or disposed.

Portable utensils are generally comprised of plastic forks, spoons, knives, sporks or other utensils that are relatively easy to transport. However, these plastic utensils are typically disposed following use as they generally do not hold up well to repeated cleaning processes. These plastic utensils account for a portion of the one million barrels of oil every day that are used to make the amount of plastic products used each year in the United States, including forty (40) billion plastic forks, knives and spoons that are tossed into the trash each year. These forty (40) billion plastic fork, knives and spoons take up space in landfills for thousands of years and cause a significant economic impact on the United States economy.

Cafeteria-style bins used at food courts, lunch rooms and restaurants that store forks, spoons, knives and other utensils are a potential health hazard. Patrons who dig through and touch these utensils in the community bins transmit substances that are on their hands onto the utensils. The utensils are subsequently used by unsuspecting patrons to eat their food who are exposed to bacteria or other materials left on the utensils by the previous patrons who rummaged through the utensils. This situation can be exacerbated in a school lunchroom where children potentially pass germs to each other through the community utensil bins. Any variety of substance can be passed from patron to patron when using these community bins.

Home utensils are typically constructed of a metallic material and are able to withstand repeated washing processes. However, these metallic utensils and even the plastic utensils are relatively bulky for daily transport by users and are relatively awkward for an individual to carry for personal use.

It would be desirable to design and construct a personal utensil that may be enclosed for transport to limit contamination while being small and light enough to transport for daily personal use. It is also desirable that these personal utensils function at a high level. The personal utensil and container of the present application addresses limitations of prior art utensils and is commercially marketed under the trade name Youtensil™.

BRIEF SUMMARY OF THE INVENTION

In a preferred embodiment, the present application is directed to a personal utensil and container for transporting the utensil in a sanitary fashion. The personal utensil and container includes a first container portion, a second container portion pivotably mounted to the first container portion, a hinge secured to the first and second container portions, a utensil and a lock mechanism. The first container portion is pivotable between a closed position defining a storage cavity and an open position exposing a first inner surface of the first container portion and a second inner surface of the second container portion. The hinge is secured to the first and second container portions and defines a pivot axis. The first and second container portions are pivotable about the pivot axis. The utensil is movably mountable within the storage cavity. The lock mechanism engages the second container portion in the closed position to releasably secure the first container portion to the second container portion in the closed position.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
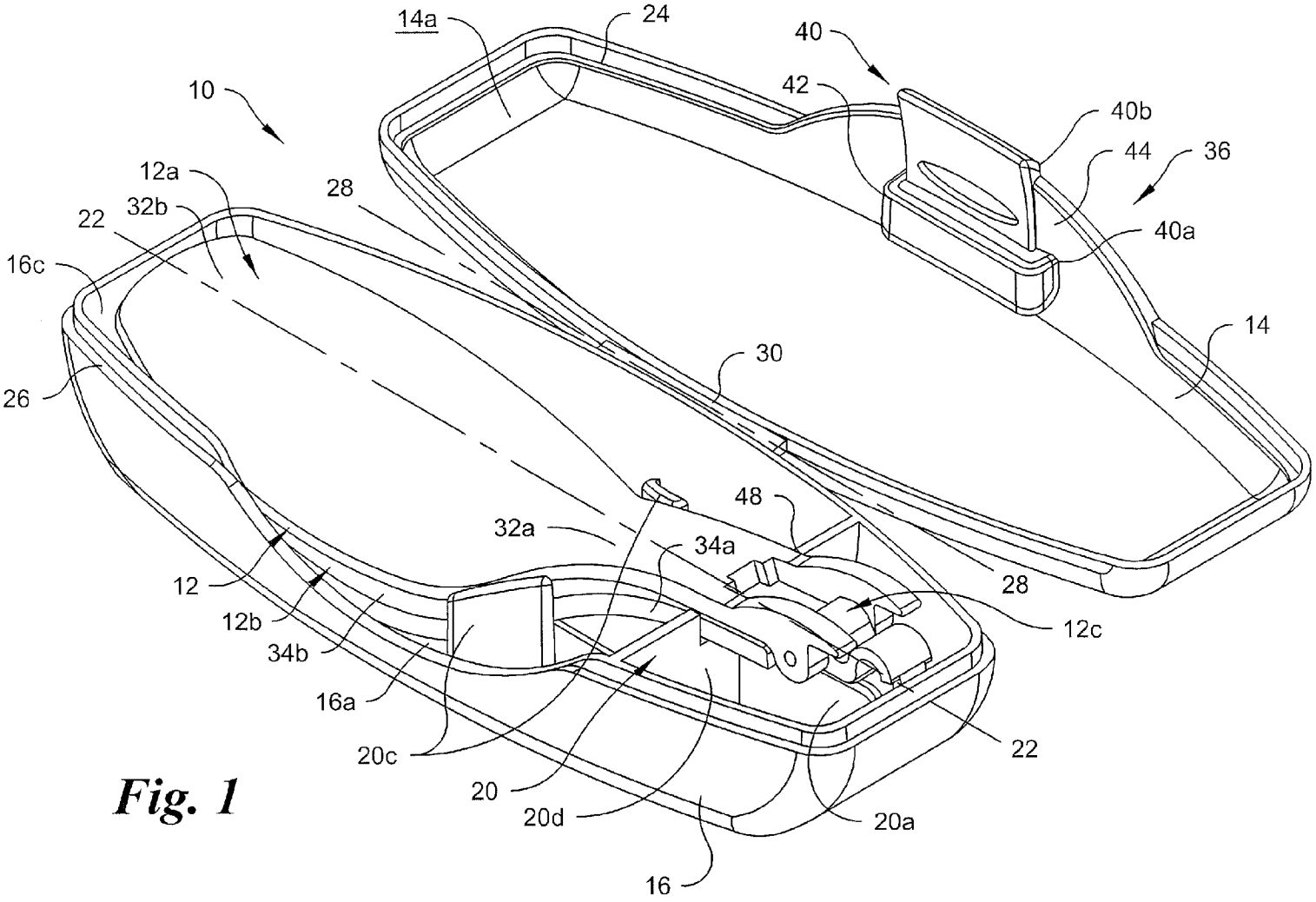
FIG. 1 is a top perspective view of a personal utensil and container in accordance with a first preferred embodiment of the present invention, wherein the container is in an open position.

Certain terminology is used in the following description for convenience only and is not limiting. Unless specifically set forth herein, the terms "a", "an" and "the" are not limited to one element but instead should be read as meaning "at least one". The words "right," "left," "lower," and "upper"

designate directions in the drawings to which reference is made. The words "inwardly" or "distally" and "outwardly" or "proximally" refer to directions toward and away from, respectively, the geometric center or orientation of the device and related parts thereof. The terminology includes the above-listed words, derivatives thereof and words of similar import.

Referring to FIGS. 1-7, in a first preferred embodiment, the present application is directed to a personal utensil and container 10 for transporting the utensil 12 in a relatively sanitary fashion. The personal utensil and container 10 is preferably promoted and marketed under the name Youtensil™. The personal utensil and container 10 of the first preferred embodiment includes a first container portion or lid 14 and a second container portion or base 16. The second container portion or base 16 is pivotably mounted to the first container portion or lid 14. The lid 14 is pivotable from a closed position (FIGS. 2A-2C), defining a generally closed storage cavity 18, and an open position (FIGS. 1 and 3) exposing a first inner surface 14*a* of the lid 14 and a second inner surface 16*a* of the base 16.

The first and second container portions 14, 16 are preferably constructed of a polymeric material that is formed into the general size and shape of the lid and base 14, 16 by an injection molding process. For example, in a preferred construction, the lid and base 14, 16 are constructed using an injection molding process, resulting in a construction that is recyclable, functional and able to withstand the typical operating conditions of the personal utensil and container 10. The first and second container portions 14, 16 are not limited to constructions utilizing injection molding of polymeric, polycarbonate or plastic materials, but rather may be comprised of nearly any material that is able to take on the general size and shape of the lid 14 and base 16 and withstand a normal operating conditions of the lid 14 and base 16. For example, the lid 14 and base 16 may be constructed of a wide variety of other materials, including, but not limited to metallic, wooden or other material or may be constructed of composite materials.

The lid 14 and/or base 16 may include a logo 15 formed, printed or otherwise attached thereto to promote a company, product, event or other item. The personal utensil and container 10 may be utilized as a promotional product in such configurations.

Figure 2A:
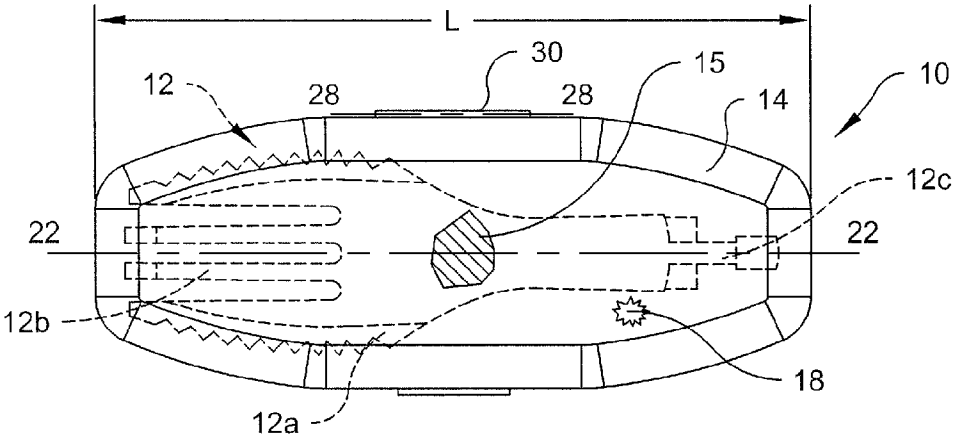
FIG. 2A is a top plan view of the personal utensil and container of FIG. 1, shown in a closed position.
Figure 2C:
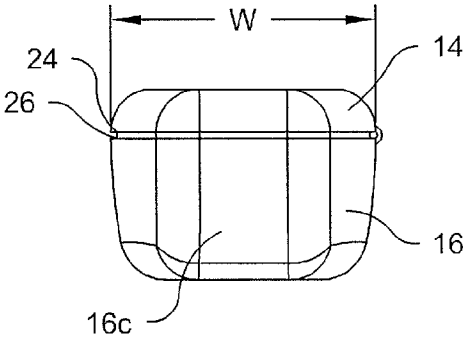
FIG. 2C is a right-side elevational view of the personal utensil and container of FIG. 1.
Figure 2B:
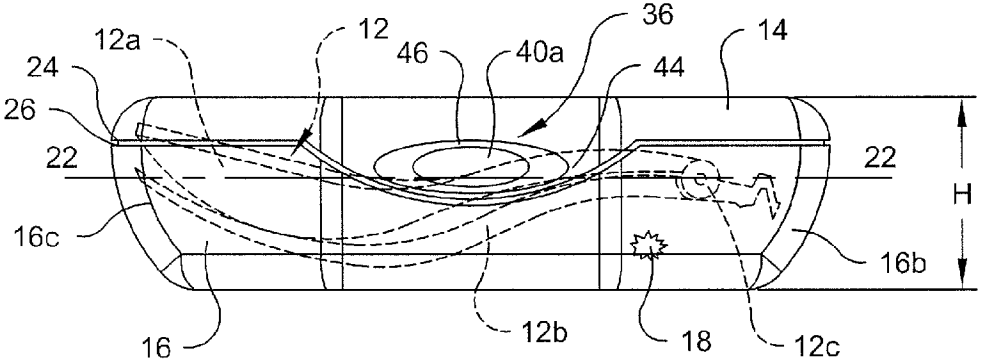
FIG. 2B is a front elevational view of the personal utensil and container of FIG. 1.
Figure 3:
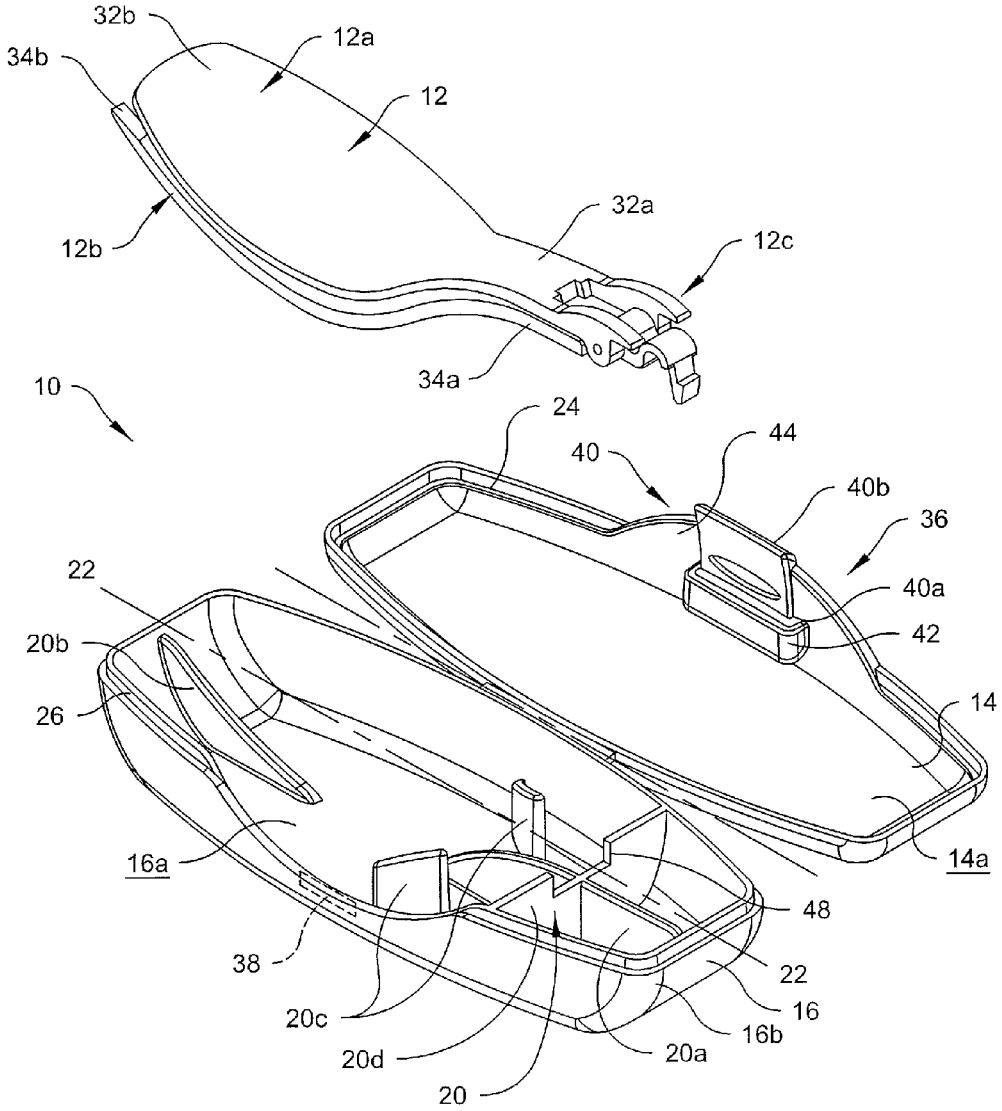
FIG. 3 is a top perspective, partially exploded view of the personal utensil and container of FIG. 1, shown in the opened position.

Referring to FIGS. 1-3, in the preferred embodiment, ribs 20 extend from the second inner surface 16*a* into the storage cavity 18. The ribs 20 support the utensil 12 in the storage cavity 18 in a storage configuration. The ribs 20 are preferably sized and configured to secure the utensil 12 from significant movement within the storage cavity 18 in the storage configuration. In the preferred embodiment, the ribs 20 include at least a first longitudinal rib 20*a* proximate a first end 16*b* of the second container portion 16, a second longitudinal rib 20*b* proximate a second end 16*c* of the second container portion 16 and a pair of arcuate ribs 20*c* proximate the first longitudinal rib 20*a*. The ribs 20 also preferably include a first transverse rib 20*d* proximate the first longitudinal rib 20*a*. The first and second longitudinal ribs 20*a*, 20*b* extend generally parallel to a longitudinal axis 22 defined by the second container portion or base 16 and the first transverse rib 20*d* preferably extends generally perpendicular to the longitudinal axis 22. The ribs 20 are not limited to the first longitudinal rib 20*a*, second longitudinal rib 20*b*, arcuate ribs 20*c* and first transverse rib 20*d* or from exclusively extending from the second inner surface 16*a* of the second container portion 16. The ribs 20 may be comprised of nearly any support or element that provides support and stability for the utensil 12 in the storage configuration. For example, the ribs 20 may be comprised of foam, pins, alternatively ranged ribs or other support elements that extend from the first and/or second inner surfaces 14*a*, 16*a* or otherwise relative to the lid and base 14, 16. In addition, the ribs 20 are not limited to supporting the utensil 12 and may be configured to provide strength and stability to the personal utensil and container 10 or may be otherwise configured.

The personal utensil and container 10 is not limited to inclusion of the ribs 20 and the lid 14 and base 16 may be sized and configured to alternatively support the utensil 12 therein without the inclusion of the ribs 20. However, the ribs 20 are preferred to provide support for the utensil 12, strength and stiffness to the lid 14 and base 16 and to generally space the utensil 12 from the inner surfaces 14*a*, 16*a* for sanitary purposes.

The ribs 20 are preferably integrally molded with the base 16 in the first preferred embodiment. Integrally molding the ribs 20 with the base 16 provides a relatively simple manufacturing process, common materials for the base 16 and ribs 20 and strength and stiffness to the base 16.

In the first preferred embodiment, the first container portion or lid 14 includes a first continuous edge 24 and the second container portion or base 16 includes a second continuous edge 26. In the closed position, the first continuous edge 24 is preferably in facing engagement with the second continuous edge 26. Accordingly, in the closed position, the storage cavity 18 is preferably closed or sealed to limit exposure of the utensil 12 to the external environment, such as contaminants, pieces of dirt or soil, relatively large pieces of lint or other potential contaminating materials. The first continuous edge 24 and the second continuous edge 26 are not generally hermetically sealed or in complete facing engagement along their entire lengths, but are preferably in facing engagement or engagement along at least portions of their length to limit exposure of the utensil 12 to certain contaminants.

Referring to FIGS. 2A-2C, in the first preferred embodiment, in the closed position, the first and second container portions or lid 14 and base 16 have a length L, a width, W an a height H. In the first preferred embodiment, the length L is approximately four and one half inches (4½"), the width W is approximately one and three quarters inches (1¾") and the height H is approximately one inch (1"). The length L, width W and height H are not limited to these specific dimensions, but these dimensions are preferred for the lid 14 and base 16 to enclose the utensil 12 and permit relatively simple transport of the personal utensil and container 10 of the first preferred embodiment. The length L, width W and height H may take on nearly any dimension that permits a user to transport the personal utensil and container 10.

Referring to FIGS. 1-7, the lid 14 and base 16 are secured to each other by a hinge 30 that defines a pivot axis 28. The lid 14 and base 17 are pivotable about the pivot axis 28. Accordingly, a user is able to pivot the lid 14 and base 16 about the pivot axis 28 on the hinge 30 between the open and closed positions.

In the first preferred embodiment, the hinge 30 is comprised of a living hinge 30. The lid 14, base 16 and hinge 30 are preferably constructed of a polymeric material in an injection molding process. The hinge 30 is not limited to being constructed of a living hinge or to being injection molded with the lid 14 and base 16 and may be comprised of a separate hinge 30 that is mounted to the lid 14 and base 16 or nearly any other component that permits the lid 14 and base 16 to be positioned in the closed and opened positions.

However, the hinge 30 is preferably constructed of the living hinge 30 to simplify manufacturability of the personal utensil and container 10.

Referring to FIGS. 1-3, in the first preferred embodiment, the utensil 12 may include a spoon, a fork, a spork, a combination spoon and fork, a stirring stick or other utensil. In the first preferred embodiment, the utensil 12 is comprised of a spoon 12*a* and a fork 12*b* that are pivotably mounted to each other at a pivot joint 12*c*. In the storage configuration, the spoon 12*a* and fork 12*b* are pivoted into facing engagement with or into close proximity to each other to provide a relatively low profile for storage in the storage cavity 18. The spoon 12*a* and fork 12*b* may be removed from the storage cavity 18 for use and pivoted about the pivot joint 12*c* or disengaged from each other at the pivot joint 12*c* for use. In the storage configuration, the spoon 12*a* and fork 12B are pivoted into facing engagement with or into close proximity with each other and engaged with the ribs 20 so that movement of the utensil 12 is limited. For example, the utensil 12 is preferably fit into grooves 48 in the ribs 20 to secure the utensil 12 to the base 16 in the storage configuration of the first preferred embodiment. The utensil 12 and grooves 48 may also be sized and configured such that the utensil 12 snap-fits into the grooves 48 to secure the utensil 12 relative to the lid 14 and base 16.

In the first preferred embodiment, the spoon 12*a* includes a spoon handle 32*a* and a spoon end 32*b* and the fork 12*b* includes a fork handle 34*a* and a fork end 34*b*. The spoon 12*a* is pivotable relative to the fork 12*b* about the pivot joint 12*c* proximate the ends of the spoon handle 32*a* and fork handle 34*a*.

Figure 4:
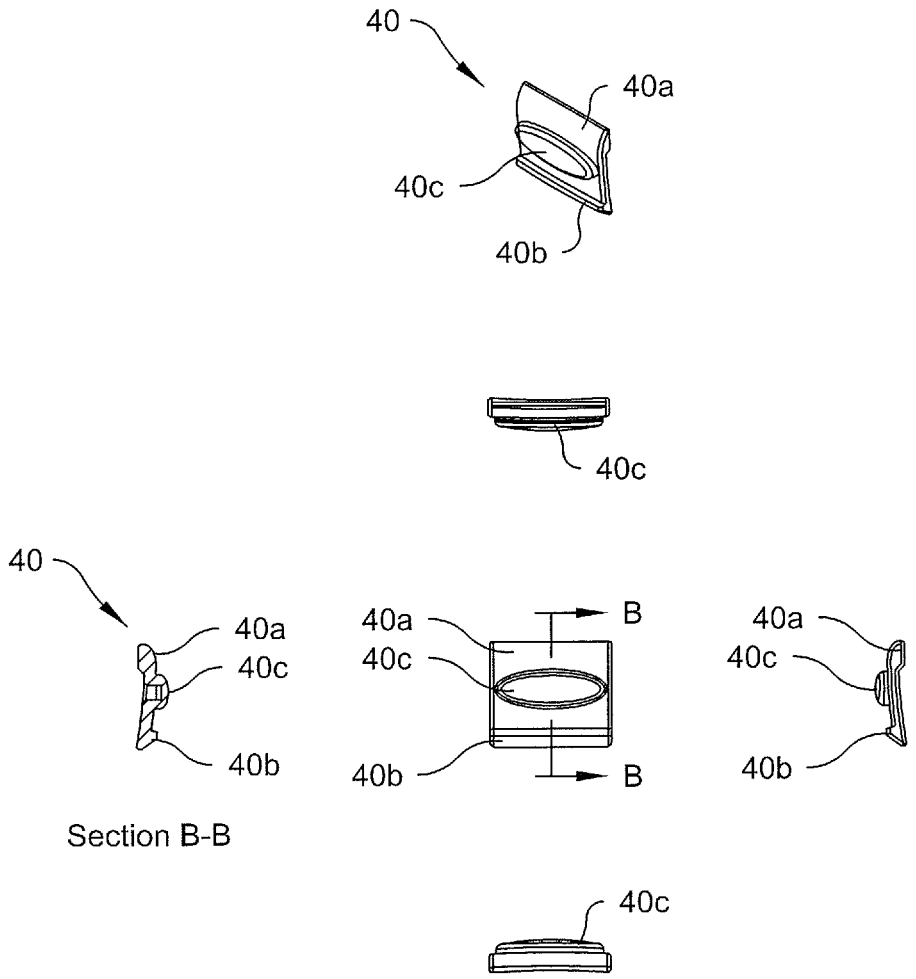
FIG. 4 is a variety of views of a locking arm of the personal utensil and container of FIG. 1.
Figure 5:
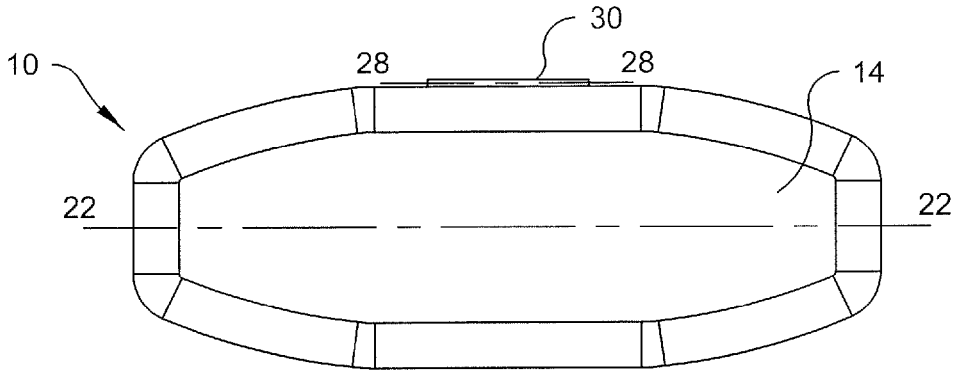
FIG. 5 is a top plan view of the personal utensil and container of FIG. 1.
Figure 6:
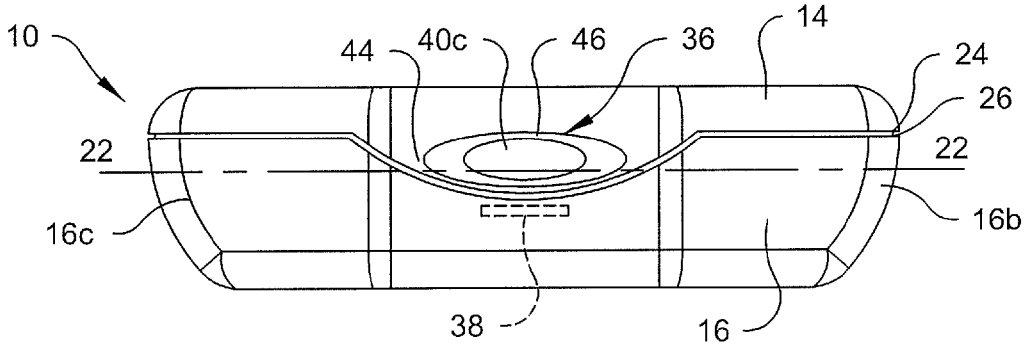
FIG. 6 is a rear elevational view of the personal utensil and container of FIG. 1
Figure 7:
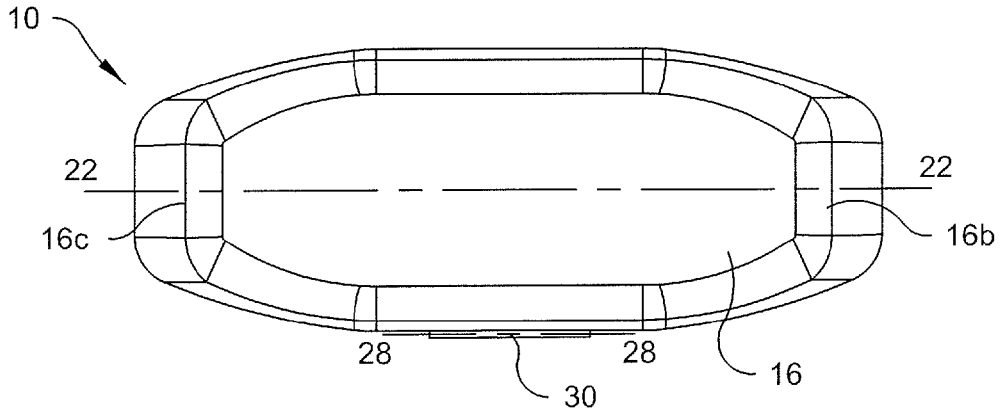
FIG. 7 is a bottom plan view of the personal utensil in a container of FIG. 1.

Referring to FIGS. 1, 3 and 4, the personal utensil and container 10 includes a lock mechanism 36 mounted to the first container portion or lid 14. The lock mechanism 36 engages the second container portion or base 16 in the closed position to releasably secure the first container portion or lid 14 to the second container portion or base 16 in the closed position. A locking ledge 38 (dashed in FIG. 3) preferably extends from the second inner surface 16*a* and is engaged by the lock mechanism 36 in the closed position to secure the lid 14 to the base 16. In the first preferred embodiment, the lock mechanism 36 includes a locking arm 40 having a butt end 40*a* mounted to the first inner surface 14*a* and a hook end 40*b* spaced from the butt end 40*a*. The hook end 40*b* engages the locking edge 38 in the closed position. The locking arm 40 is preferably flexibly mounted to the lid 14 such that the hook end 40*b* may move or pivot relative to the butt end 40*a*. The locking arm 40 is mounted in a hub 42 extending from the first inner surface 14*a* in the first preferred embodiment to permit the pivoting movement of the hook end 40*b*. The hub 42 is preferably co-molded with the lid 14 of the same polymeric material as the lid 14, but is not so limited.

The locking arm 40 also preferably includes a button 40*c* on a side surface between the butt end 40*a* and the hook end 40*b*. The lid 14 preferably includes an overhang 44 with a lock hole 46 therein proximate the hub 42. The button 40*c* preferably extends through the lock hole 46 in the opened and closed positions. To disengage the hook end 40*b* from the ledge 38, the user pushes the button 40*c* thereby pivoting the hook end 40*b* away from the ledge 38 and permitting the hook end 40*b* to clear the ledge 38 to permit the lid 14 to pivot out of engagement with the base 16. The locking arm 40 is preferably constructed of a polymeric material that is somewhat flexible to permit this pivoting movement, but rigid and strong enough to hold the lid 14 relative to the base 16 in the closed position during typical use.

The locking mechanism 36 and ledge 38 are not limiting for securing the lid 14 to the base 16 in the closed position. For example, the lid 14 may be secured to the base 16 by a snap fit between the first and second continuous edges 24, 26 or alternative securing mechanisms may be utilized.

Figure 8:
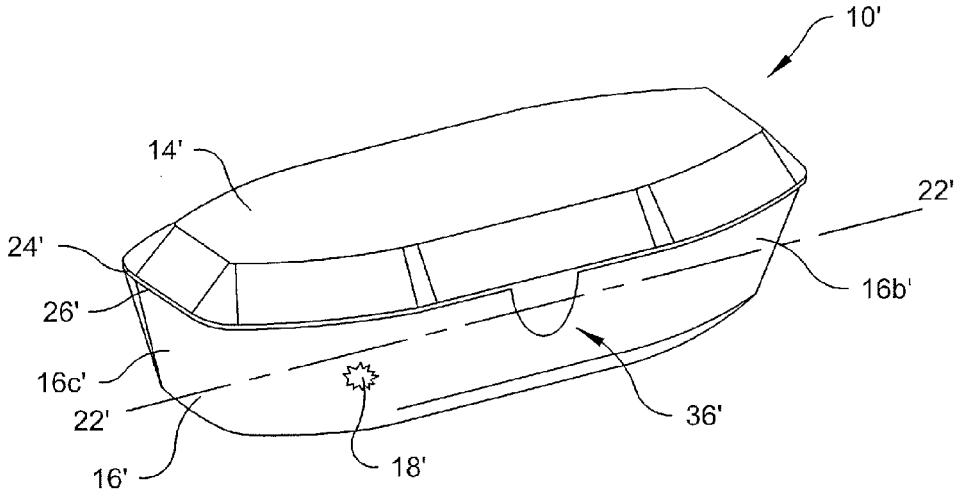
FIG. 8 is a top perspective view of a personal utensil and container in accordance with a second preferred embodiment of the present invention, shown in the closed position.
Figure 9:
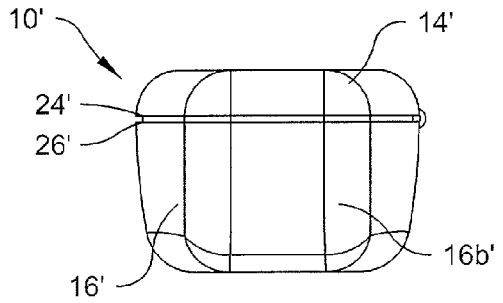
FIG. 9 is a left-side elevational view of the personal utensil and container of FIG. 8.

Referring to FIGS. 8 and 9, in a second preferred embodiment, the personal utensil and container 10 includes an alternate lock mechanism 36'. Similar components are identified by the same reference numerals between the first and second preferred embodiments with the components of the second preferred embodiment being distinguished with a prime symbol (').  The lock mechanism 36' of the second preferred embodiment is comprised of a snap fit between the first continuous edge 24' and the second continuous edge 26' and an indentation 50 in the base 16' on a front of the base 16' adjacent the second continuous edge 26'. The indentation permits a user to insert their finger therein to apply an upward force on the lid 14' to disengage the snap fit at the first and second continuous edges 24', 26' and move the personal utensil and container 10' from the closed position to the open position.

Figure 10:
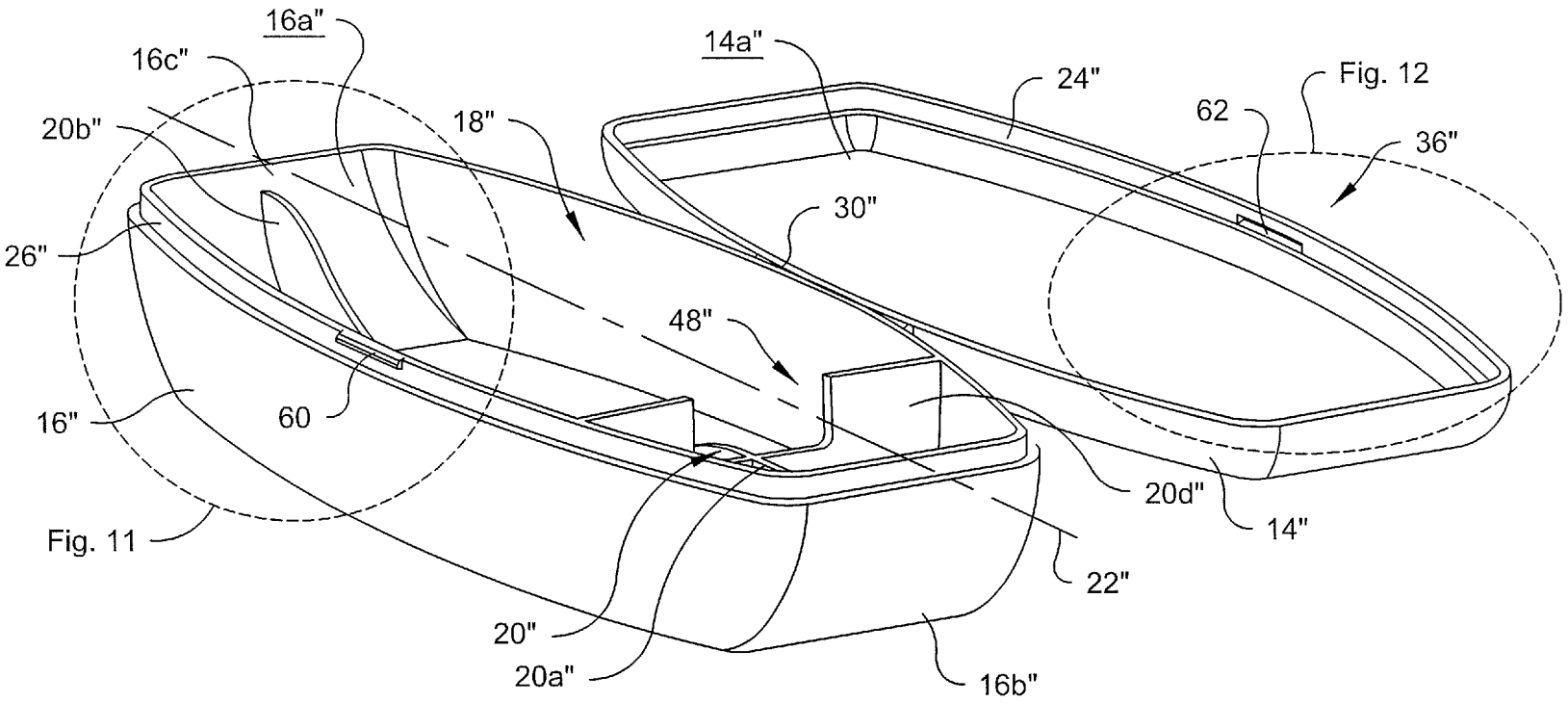
FIG. 10 is a top perspective view of a container in accordance with a third preferred embodiment of the present invention, shown in the open position.
Figure 11:
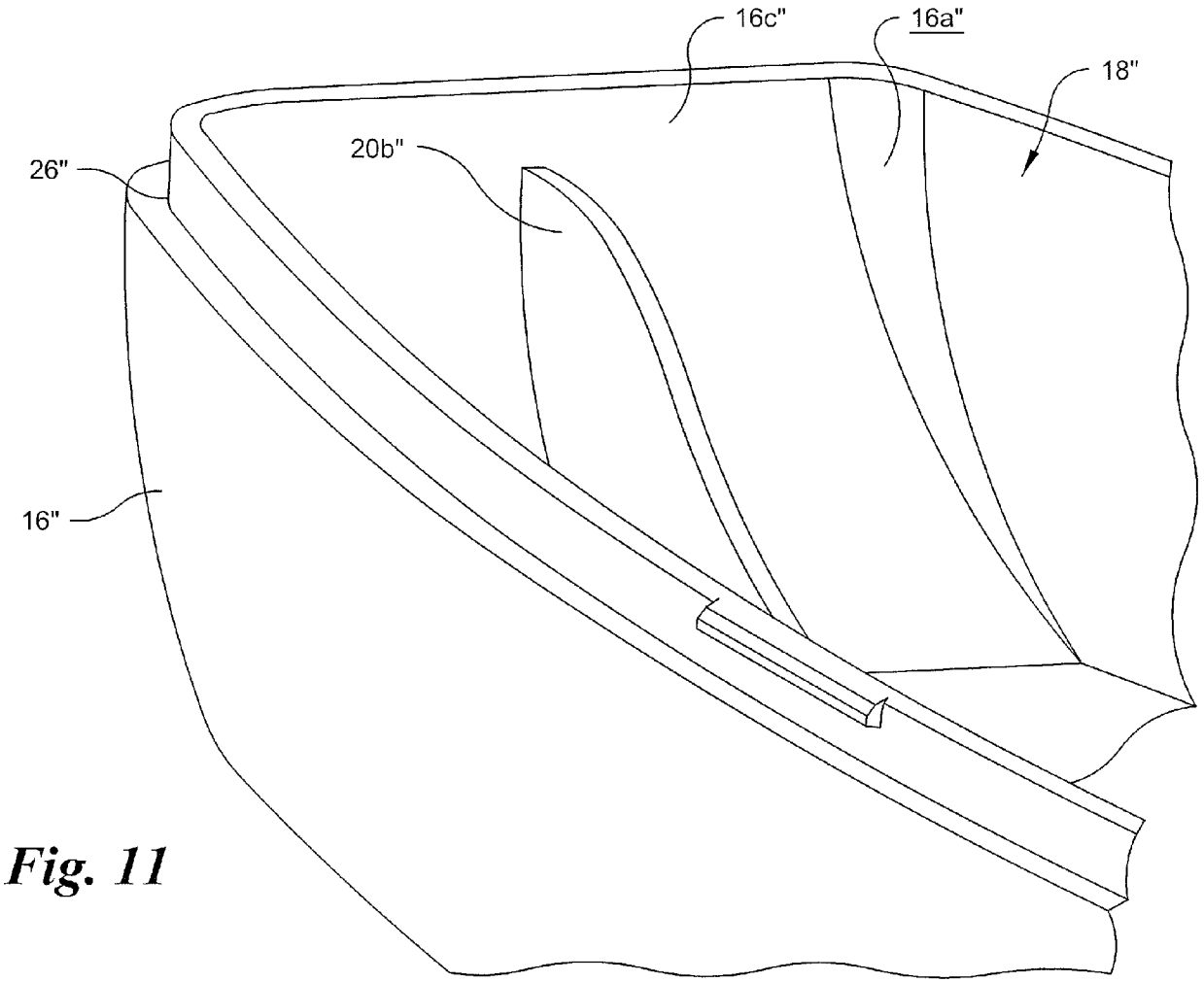
FIG. 11 is a top perspective view of a portion of a base of the container of FIG. 10, taken generally from within circle 11 of FIG. 10.
Figure 12:
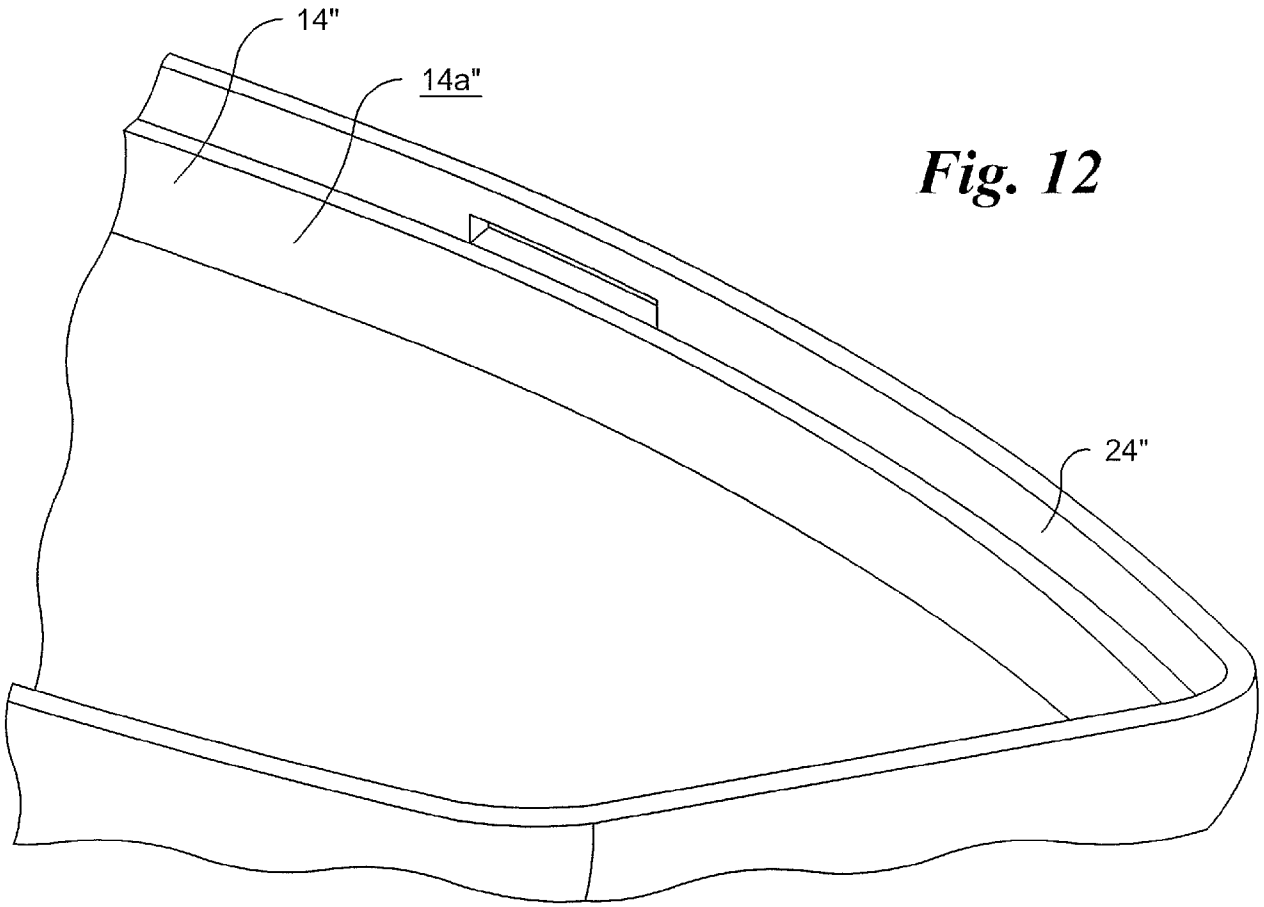
FIG. 12 is a top perspective view of a portion of a lid of the container of FIG. 10, taken generally from within circle 12 of FIG. 10.

Referring to FIGS. 10-12, in a third preferred embodiment, the personal utensil and container 10 includes an alternate lock mechanism 36". Similar components are identified by the same reference numerals between the first, second and third preferred embodiments with the components of the third preferred embodiment being distinguished with a double prime symbol ("). The lock mechanism 36" of the third preferred embodiment is comprised of a protrusion 60 extending outwardly from the base 16" proximate the second continuous edge 26" that mates with a cavity 62 formed on the lid 14" proximate the first continuous edge 24". In the closed position, the protrusion 60 is positioned in the cavity 62 to generally secure the lid 14" to the base 16". The lid 14" may be moved from the closed position to the open position by urging the lid 14" to pivot about the hinge 30" such that the lid 14" and/or base 16" flex or deform proximate the protrusion 60 and cavity 62 to release the protrusion 60 from the cavity 62. The protrusion 60 and cavity 62 preferably define a snap fit between the lid 14" and base 16" in the third preferred embodiment such that the lid 14" and or base 16" are deflected or elastically deformed as the protrusion 60 moves in and out of the cavity 62.

Figure 13:
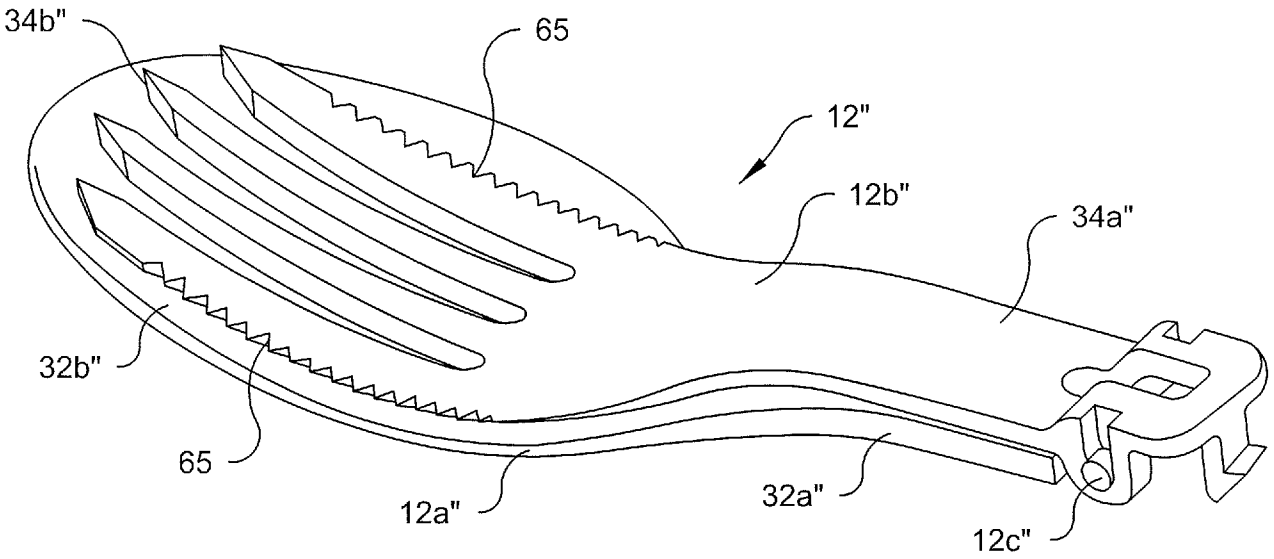
FIG. 13 is a top perspective view of a utensil for use with the container of FIG. 10 in accordance with the third preferred embodiment of the present invention.
Figure 14:
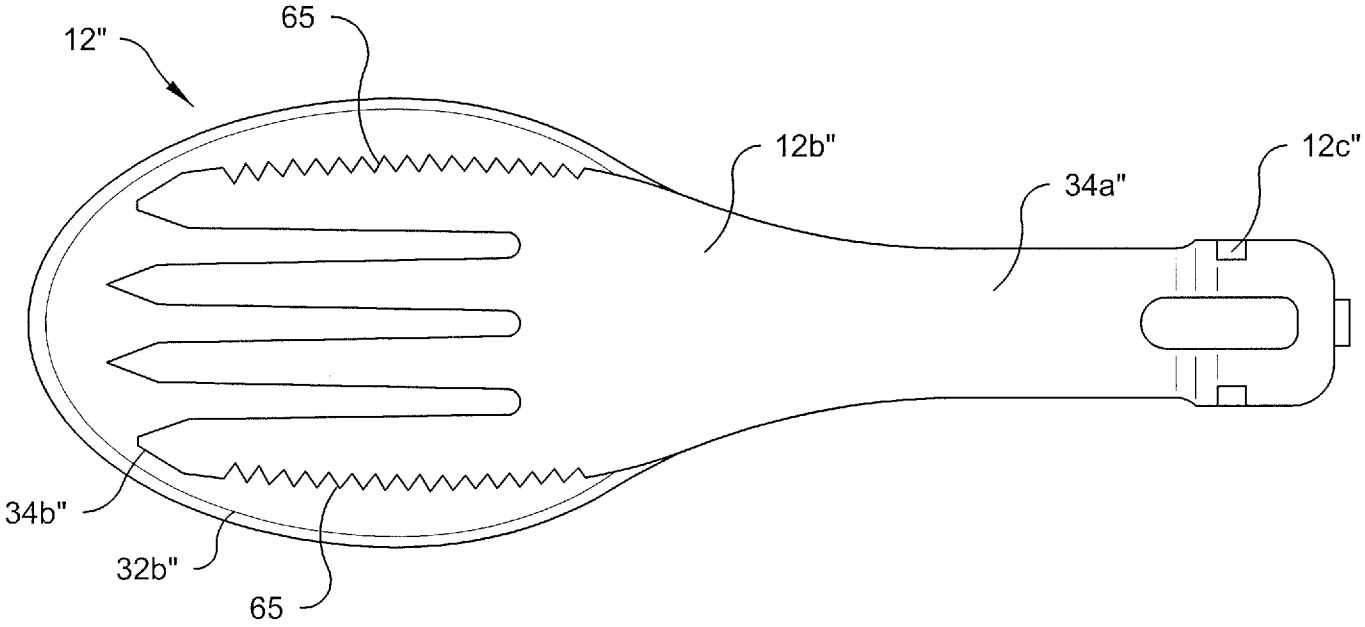
FIG. 14 is a top plan view of the utensil of FIG. 13.
Figure 15:
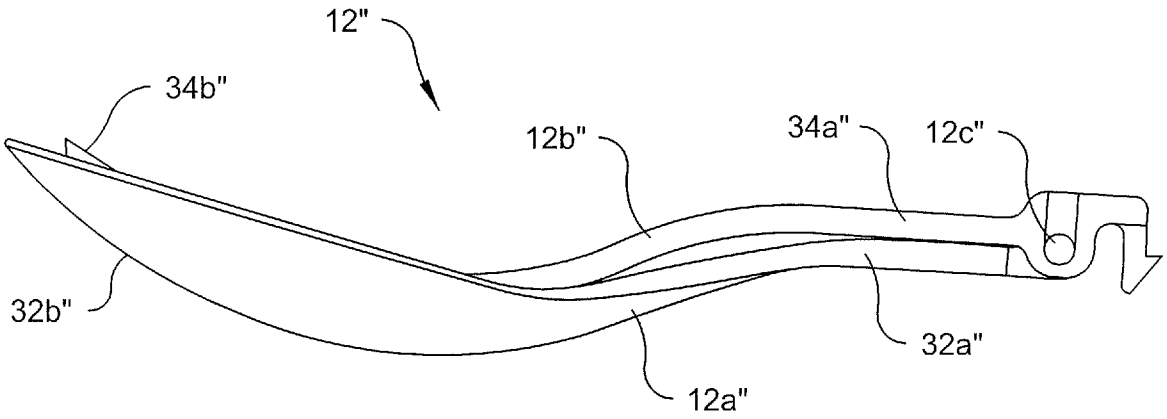
FIG. 15 is a side elevational view of the utensil of FIG. 13.

Referring to FIGS. 13-15, in the third preferred embodiment, the fork 12*b*" of the utensil 12" includes serrated edges 65 on both sides of the fork end 34*b*", such that the fork 12*b*" may be utilized as a knife by both left and right handed individuals. The fork 12*b*" of the third preferred embodiment is not limited to having serrated edges 65 on both of its sides and may include the serrated edge 65 on only one side or no serrated edges 65. However, in the third preferred embodiment, it is preferred that the fork 12*b*" includes the serrated edges 65 on both sides such that the fork 12*b*" may be utilized as a knife by left and right handed individuals. In addition, the serrated edges 65 are not limited to being incorporated on the fork 12*b*" and may be incorporated on the spoon 12*a*" such that it may be utilized as a knife or on nearly any other utensil 12" that may be incorporated into the third preferred embodiment. The utensil 12" is preferably positionable in the container between the base 16" and lid 14" of the third preferred embodiment for transport and storage.

Referring to FIGS. 1-15, in use, the personal utensil and container 10, 10' of the first, second and third preferred embodiments is positioned in the closed position to cover and generally protect the utensil 12, 12" in the storage cavity 18, 18', 18". When the user needs the utensil 12, 12", the lid 14, 14', 14" is pivoted relative to the base 16, 16', 16" to move the personal utensil and container 10, 10' to the open position (e.g. FIG. 1). The user grasps the utensil 12, 12" and removes the utensil 12, 12" from the base 16, 16', 16" by removing the utensil 12, 12" from the grooves 48, 48".

In the first and third preferred embodiments, the spoon 12*a*, 12*a*" is pivoted about the pivot joint 12*c*, 12*c*" relative to the fork 12*b*, 12*b*" such that the spoon 12*a*, 12*a*" and/or fork 12*b*, 12*b*" may be utilized to manipulate foodstuff. Alternatively, the spoon 12*a*, 12*a*" may be detached from the fork 12*b*, 12*b*" at the pivot joint 12*c*, 12*c*" to use the spoon and/or fork 12*b*, 12*b*". In the third preferred embodiment, the fork 12*b*" may also be utilized as a knife by left and right handed individuals by employing the serrated edges 65. Following use, the spoon 12*a*, 12*a*" and fork 12*b*, 12*b*" are cleaned and mounted together at the pivot joint 12*c*, 12*c*". The spoon 12*a*, 12*a*" and fork 12*b*, 1 2*b*" are pivoted into facing engagement with or into close proximity to each other to provide a relatively low profile for storage and are mounted to the ribs 20, 20" in the base 16, 16". The lid 14, 14', 14" is pivoted toward the base 16, 16', 16" until the first and second continuous edges 24, 24', 24", 26, 26', 26" are in close proximity to each other on in facing engagement with each other such that the lock mechanism 36, 36', 36" secures the lid 14, 14', 14" to the base 16, 16', 16" in the closed position. In the closed position, the personal utensil and container 10, 10' may be again transported with the user.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A personal utensil and container for transporting the utensil in a relatively sanitary fashion, the personal utensil and container comprising:

a first container portion;

a second container portion pivotably mounted to the first container portion, the first container portion pivotable between a closed position defining a storage cavity and an open position exposing a first inner surface of the first container portion and a second inner surface of the second container portion, the utensil mountable within the storage cavity, the utensil including a fork portion and a spoon portion connected at a pivot joint at handle portions of the fork portion and the spoon portion, a longitudinal rib extending from the second inner surface, the longitudinal rib having a concave arcuate portion extending substantially parallel to a longitudinal axis of the container, a transverse rib extending from the second inner surface substantially transverse to the longitudinal axis, the transverse rib including a handle groove proximate the longitudinal axis that releasably receives the handle portions in a storage configuration;

a hinge secured to the first and second container portions defining a pivot axis, the first and second container portions being pivotable about the pivot axis; and a lock mechanism mounted to the first container portion, the lock mechanism engaging the second container portion in the closed position to releasably secure the first container portion to the second container portion.

2. The personal utensil and container of claim 1, wherein the longitudinal rib includes a first longitudinal rib proximate a first end of the second container portion and a second longitudinal rib proximate a second end of the second container portion, a pair of arcuate ribs extending from the second inner surface proximate the first longitudinal rib.

3. The personal utensil and container of claim 2 wherein the first transverse rib is positioned proximate the first longitudinal rib.

4. The personal utensil and container of claim 1 further comprising:

a locking ledge extending from the second inner surface, the lock mechanism engaging the locking ledge in the closed position.

5. The personal utensil and container of claim 1 wherein the fork portion includes serrated edges.

6. The personal utensil and container of claim 1 wherein the lock mechanism includes a locking arm including a butt end mounted to the first inner surface and a hook end, the hook end engaging a locking ledge mounted to the second container portion in the closed position.

7. The personal utensil and container of claim 6 wherein the locking arm includes a button on a side surface between the butt end and the hook end, the locking arm pivotable about the butt end.

8. The personal utensil and container of claim 1 wherein the first container portion includes a first continuous edge and the second container portion includes a second continuous edge, the first edge being in facing engagement with the second edge in the closed position.

9. The personal utensil and container of claim 1 wherein the first container portion includes an overhang with a lock hole therein, the lock mechanism includes a locking arm with a button thereon, the button extending through the lock hole in the closed position.

10. The personal utensil and container of claim 1 wherein the spoon portion includes a spoon end and the fork portion includes a fork end.

11. The personal utensil and container of claim 1 wherein the hinge is a living hinge, the first container portion, the second container portion and the living hinge constructed of a polymeric material.

12. The personal utensil and container of claim 1 wherein the first and second container portions have a length, the length being approximately four and one-half inches (4½").

13. The personal utensil and container of claim 1 wherein the first and second container portions have a width, the width being approximately one and three-quarters inches (1¾").

14. The personal utensil and container of claim 1 wherein the first and second container portions define a height in the closed position, the height being approximately one and one-quarter inches (1¼").

15. The personal utensil and container of claim 1 further comprising:

a hub extending generally perpendicularly from the first inner surface; and a locking arm having a butt end, a hook end and a button, the hook end engaging a locking ledge mounted to the second container portion in the closed position, the butt end secured to the hub.

* * * * *